US006679765B2

(12) United States Patent
Tung et al.

(10) Patent No.: US 6,679,765 B2
(45) Date of Patent: Jan. 20, 2004

(54) SLURRY SUPPLY SYSTEM DISPOSED ABOVE THE ROTATING PLATEN OF A CHEMICAL MECHANICAL POLISHING APPARATUS

(75) Inventors: Jen-Chieh Tung, Hsinchu (TW); Yu-Wei Chin, Hsinchu Hsien (TW); Kuan-Fu Chang, Hsinchu (TW); Sheng-Jan Chang, Miaoli Hsien (TW)

(73) Assignee: Promos Technologies, Inc., Hsinchu (TW)

( * ) Notice: Subject to any disclaimer, the term of this patent is extended or adjusted under 35 U.S.C. 154(b) by 0 days.

(21) Appl. No.: 10/202,883

(22) Filed: Jul. 26, 2002

(65) Prior Publication Data

US 2003/0139117 A1 Jul. 24, 2003

(30) Foreign Application Priority Data

Jan. 18, 2002 (TW) ..... 91100818 A

(51) Int. Cl.[7] ..... B24B 1/04

(52) U.S. Cl. ..... 451/60; 451/287; 451/446; 451/36

(58) Field of Search ..... 451/60, 36, 285–289, 451/296, 56, 446

(56) References Cited

U.S. PATENT DOCUMENTS

| | | | | | |
|---|---|---|---|---|---|
| 5,486,131 | A | * | 1/1996 | Cesna et al. | 451/56 |
| 5,664,990 | A | * | 9/1997 | Adams et al. | 451/60 |
| 5,702,563 | A | * | 12/1997 | Salugsugan et al. | 438/692 |
| 5,997,392 | A | * | 12/1999 | Chamberlin et al. | 451/446 |
| 6,280,299 | B1 | * | 8/2001 | Kennedy et al. | 451/67 |
| 6,283,840 | B1 | * | 9/2001 | Huey | 451/288 |
| 6,284,092 | B1 | * | 9/2001 | Manfredi | 156/345.12 |
| 2003/0013381 | A1 | * | 1/2003 | Benner et al. | 451/21 |

* cited by examiner

*Primary Examiner*—Lee D. Wilson
(74) *Attorney, Agent, or Firm*—Birch, Stewart, Kolasch & Birch, LLP

(57) ABSTRACT

A slurry supply system disposed above the rotating platen of a chemical mechanical polishing apparatus. The slurry supply system includes a wafer carrier configured to hold a semiconductor wafer to be polished; a supporting arm to support the wafer carrier; a slurry supplier connected to the supporting arm and located on the front edge of the rotating direction of the rotating platen so that the slurry supplier is positioned opposite the wafer carrier; and a plurality of openings formed on the slurry supplier to feed chemical mechanical polishing fluids, each of the openings individually supplied with individual control of the chemical mechanical polishing fluids.

20 Claims, 3 Drawing Sheets

SLURRY SUPPLY SYSTEM DISPOSED ABOVE THE ROTATING PLATEN OF A CHEMICAL MECHANICAL POLISHING APPARATUS

BACKGROUND OF THE INVENTION

1. Field of the Invention

The present invention relates to an apparatus and a method of chemical mechanical polishing (CMP) for a semiconductor wafer, more particularly, to a slurry supply system disposed above the rotating platen of a chemical mechanical polishing apparatus to improve the uniformity of the polished layer.

2. Description of the Related Art

Chemical Mechanical Polishing (CMP) is an industry-recognized process for leveling semiconductor wafers. The CMP process is used to achieve global planarization (planarization of the entire wafer). Both chemical and mechanical forces produce the desired polishing of the semiconductor wafer. For example, an insulator or a polysilicon layer filled in a shallow trench, an uneven dielectric layer, or an uneven metal layer can be planarized by CMP.

A CMP apparatus generally includes a rotating wafer carrier for holding a semiconductor wafer, a slurry supply system to feed slurry for CMP, and a rotating platen having a polishing pad on its upper surface. The semiconductor wafer is placed on a wafer carrier and pressed face down onto a polishing pad covered with a slurry of colloidal silica or alumina in deionized water.

The CMP apparatus having one slurry opening, used for global planarization has a problem related to polishing uniformity known as "edge exclusion". Edge exclusion occurs when too much of the semiconductor wafer surface is polished. This causes the edge or outer portion of the semiconductor wafer to be unusable for integrated circuit fabrication. Wafer polish throughput and polish uniformity are important process parameters, because they also directly affect the number of integrated circuit chips that a fabrication facility can produce per unit equipment for a given period of time.

U.S. Pat. No. 6,227,947 discloses an apparatus and method for chemical mechanical polishing metal on a semiconductor wafer capable of achieving improved pad life. U.S. Pat. No. 5,578,529 discloses a method for using rinse spray bar in chemical mechanical polishing, providing complete and uniform wetting and rinsing of the polishing pad for an improved process. U.S. Pat. No. 6,284,092 discloses a CMP slurry atomization slurry dispense system to dispense the slurry toward the pad preferably as a stream or more preferably drops toward the pad surface. However, the problems related to polishing uniformity cannot be completely eliminated.

Therefore, a need has arisen for a slurry supply system disposed above the rotating platen of a chemical mechanical polishing apparatus that provides improved semiconductor wafer polish uniformity.

SUMMARY OF THE INVENTION

In view of the above disadvantages, an object of the invention is to provide a slurry supply system disposed above the rotating platen of a chemical mechanical polishing apparatus. The system is capable of improving wafer polish throughput and polish uniformity.

A further object of the invention is to achieve a desirable polish profile of the polished layer.

A further object of the invention is to provide a method for supplying slurry to the rotating platen of a chemical mechanical polishing apparatus capable of improving wafer polish throughput and polish uniformity.

Accordingly, the above objects are attained by providing a slurry supply system disposed above the rotating platen of a chemical mechanical polishing apparatus. The slurry supply system includes a wafer carrier configured to hold a semiconductor wafer to be polished; a supporting arm to support the wafer carrier; a slurry supplier connected to the supporting arm and located on the front edge of the rotating direction of the rotating platen so that the slurry supplier is positioned opposite the wafer carrier; and a plurality of openings formed on the slurry supplier to feed chemical mechanical polishing fluids, each of the openings individually supplied with individual control of the chemical mechanical polishing fluids.

A further object of the invention is to provide a slurry supply system disposed above the rotating platen of a chemical mechanical polishing apparatus. The slurry supplier is preferably arc-shaped.

In accordance with one aspect of the invention, there is provided a slurry supply system further comprising a pair of bars located at the ends of the slurry supplier coupling the slurry supplier to the supporting arm. Furthermore, the bars can be flexible so that the distance between the slurry supplier and the wafer carrier is controllable.

In accordance with another aspect of the invention, there is provided a slurry supply system disposed above the rotating platen of a chemical mechanical polishing apparatus. Each of the openings connects to a flow rate controller, such as a valve or a pump via a conduit.

In accordance with further aspect of the invention, there is provided a slurry supply system disposed above the rotating platen of a chemical mechanical polishing apparatus. The chemical mechanical polishing fluids are slurry and/or deionized water.

In accordance with yet another aspect of the invention, the slurry supplier can comprise a plurality of arc-shaped sections juxtaposed to each other and attached to the supporting arm.

In accordance with a still further aspect of the invention, there is provided a method for supplying slurry to the rotating platen of a chemical mechanical polishing apparatus. First, a slurry supply system having a plurality of openings capable of individually adjusting the flow rate of the slurry is provided. Then, at least one of the openings is selected to supply a slurry having a predetermined flow rate to the rotating platen of the chemical mechanical polishing apparatus.

BRIEF DESCRIPTION OF THE DRAWINGS

The preferred embodiment of the invention is hereinafter described with reference to the accompanying drawings in which.

DETAILED DESCRIPTION OF THE INVENTION

Figure 1:
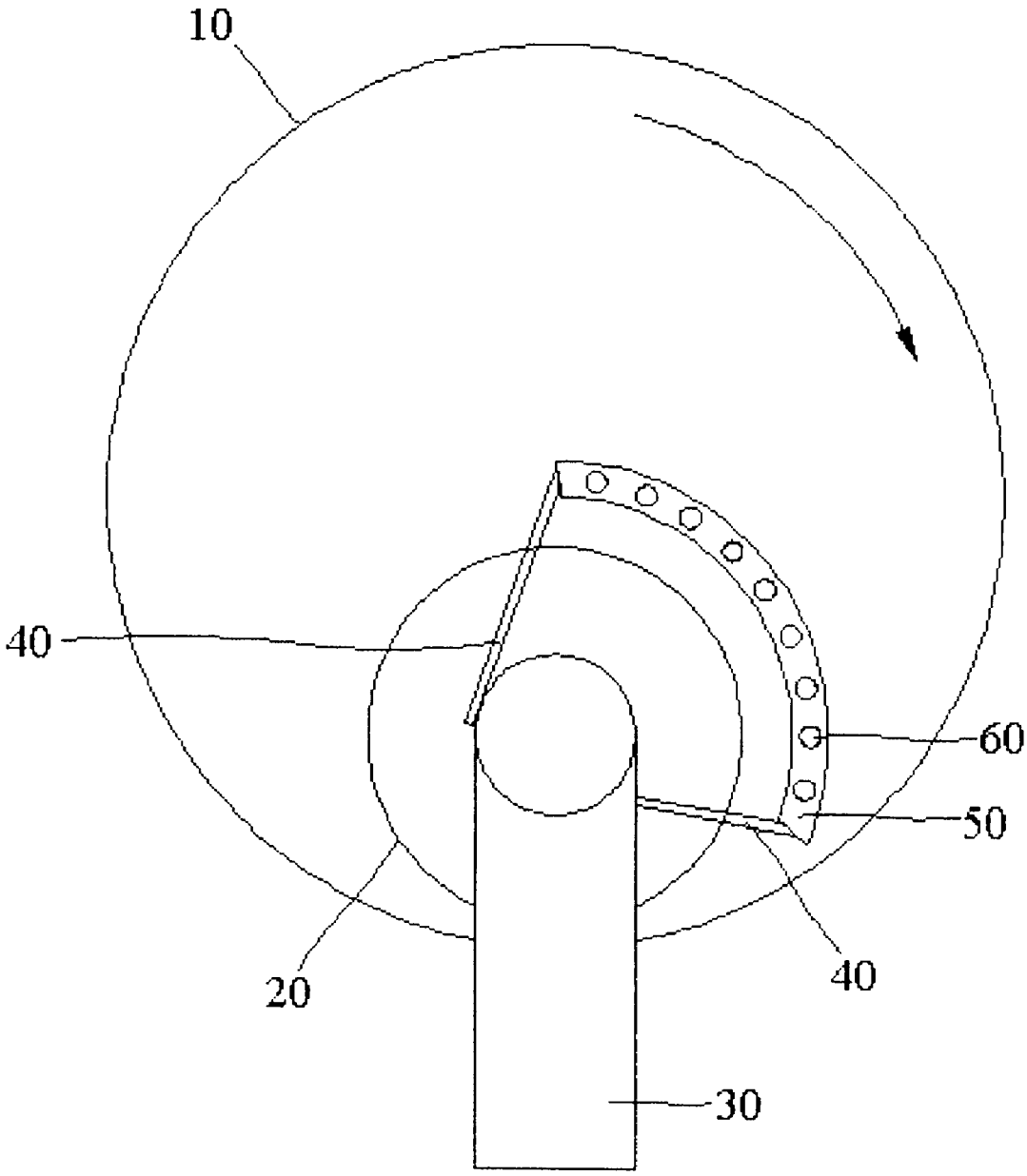
FIG. 1 is a top view illustrating a slurry supply system disposed above the rotating platen of a chemical mechanical polishing apparatus according to the preferred embodiment of the invention.

FIG. 1 is top view illustrating a slurry supply system disposed above the rotating platen of a chemical mechanical polishing apparatus according to the preferred embodiment of the invention. Also, FIGS. 2 and 3 show slurry ON/OFF controllers or flow rate controllers of slurry supply system for chemical mechanical polishing according to the preferred embodiment of the invention.

FIG. 1 shows a slurry supply system disposed above the rotating platen 10 of a chemical mechanical polishing apparatus. The slurry supply system comprises a wafer carrier 20, which is configured to hold a semiconductor wafer (not shown) to be polished. The semiconductor wafer has an uneven metal layer or an uneven insulating layer thereon. Also, the slurry supply system further comprises a supporting arm 30 used to support the wafer carrier 20 and an arc-shaped slurry supplier 50 connected to the supporting arm 30 via a pair of connecting bars 40 mounted on the ends of the slurry supplier 50. Moreover, the slurry supplier 50 is located on the front edge of the rotating direction of the rotating platen 30 so that the slurry supplier 50 is positioned opposite the wafer carrier 20. That is to say, there is a predetermined distance between the slurry supplier 50 and the wafer carrier 20. Alternately, the slurry supplier 50 can be disposed on the supporting arm 30 by flexible bars 40 so that the distance between the slurry supplier 50 and the wafer carrier 20 is changeable and controllable.

Also, a plurality of openings 60 are uniformly formed on the slurry supplier 50 to feed chemical mechanical polishing fluids such as slurry and deionized water. The chemical mechanical polishing fluids can be individually supplied and controlled by each of the openings 60 connected to a controlling valve or a pump via a conduit.

Figure 2:
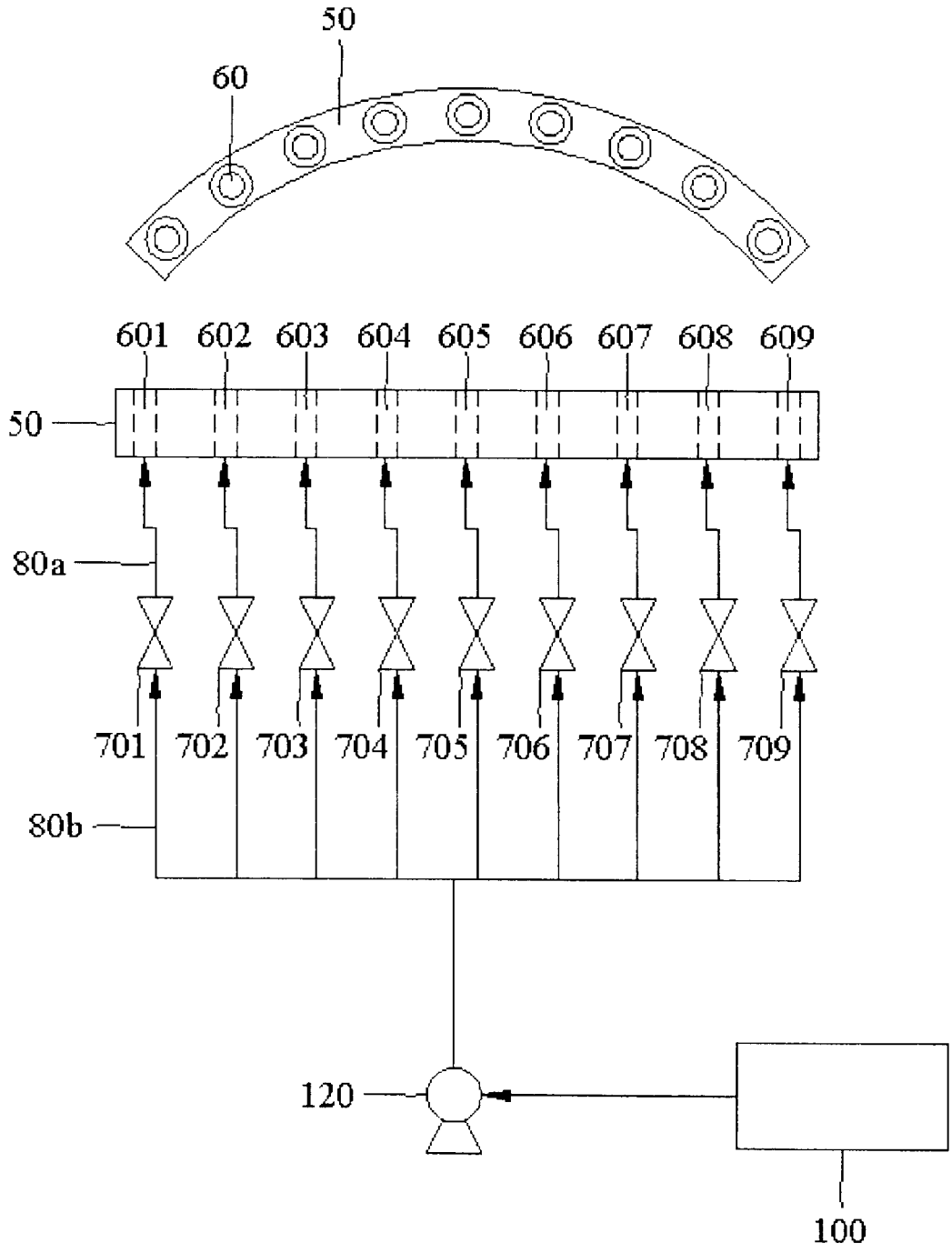
FIG. 2 shows the slurry ON/OFF controllers or flow rate controllers of the slurry supply system for chemical mechanical polishing according to the preferred embodiment of the invention.
Figure 3:
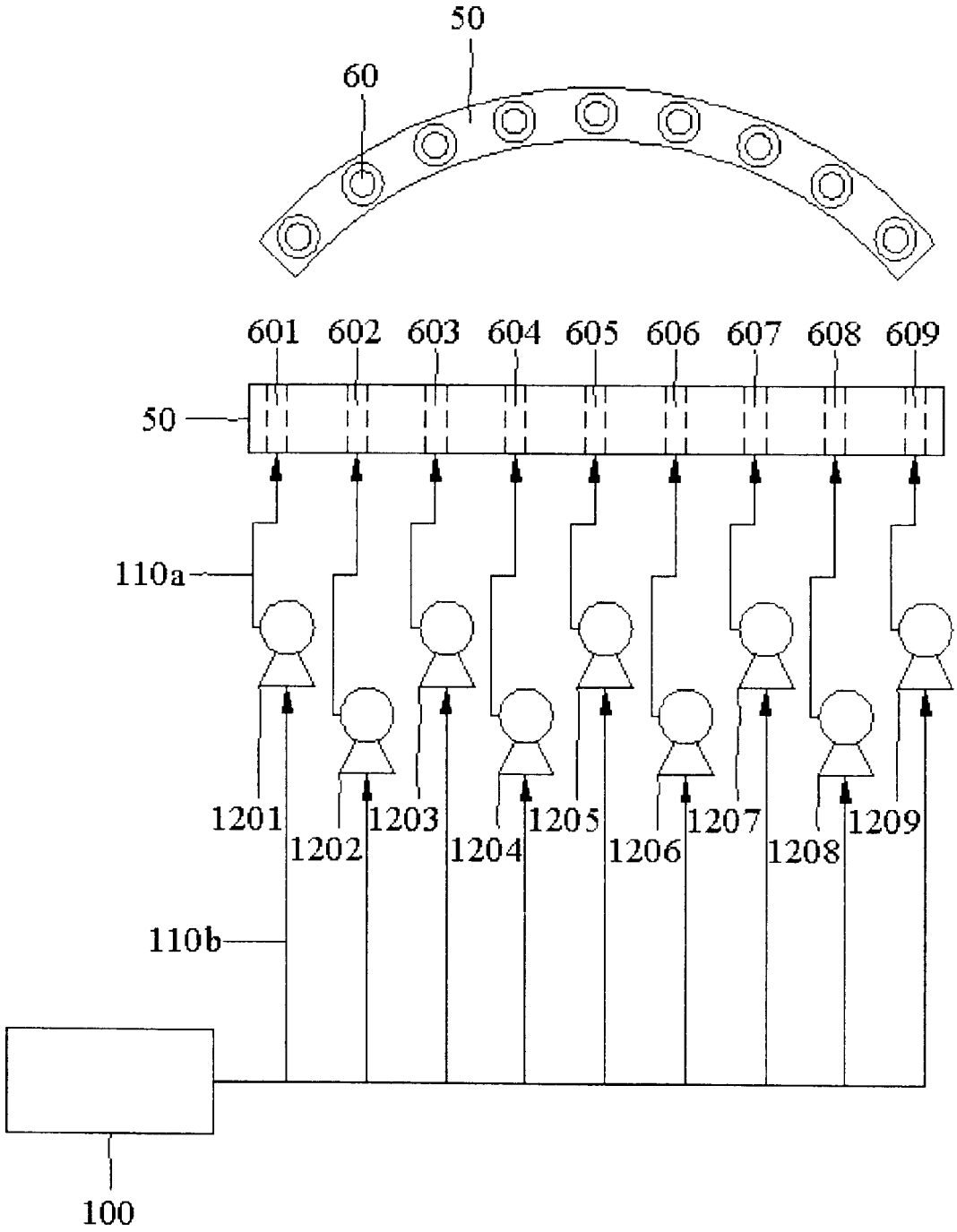
FIG. 3 shows the slurry flow rate controllers of the slurry supply system for chemical mechanical polishing according to the preferred embodiment of the invention.

FIG. 2 shows slurry ON/OFF controllers or flow rate controllers of the slurry supply system for chemical mechanical polishing. Symbols 80*a* and 80*b* indicate conduits between the opening 601 and a reservoir 100 for storage of CMP fluids. A pump 120 is secured in a conduit connected to the reservoir 100, thereby delivering the CMP fluids stored in the reservoir 100 to the slurry supplier 50. Symbols 701 to 709 indicate valves for individually adjusting the flow rate or ON/OFF of the CMP fluids. Openings 601 to 609 respectively correspond to valves 701 to 709. They are disposed to receive the CMP fluids from the reservoir 100 through slurry supplier 50.

FIG. 3 shows the slurry flow rate controllers of the slurry supply system for chemical mechanical polishing according to the preferred embodiment of the invention. Symbols 110*a* and 110*b* indicate conduits between the opening 601 and a reservoir 100 for storage of the CMP fluids. Symbols 1201 to 1209 indicate pumps corresponding to openings 601 to 609. The CMP fluids at a predetermined flow rate can be individually delivered by at least one of the pumps 1201 to 1209 from the reservoir 100 to the slurry supplier 50.

As a result, the CMP fluids such as slurry or deionized water can be supplied to the polishing pad over on the rotating platen by each of the openings 601 to 609 thus improving the polishing uniformity of the polished layer on the semiconductor wafer.

In this embodiment, a method for supplying slurry to the rotating platen of a chemical mechanical polishing apparatus is also provided. The slurry supply system having a plurality of openings is capable of individually adjusting the flow rate of the slurry. Then, at least one of the openings is selected to supply slurry having a predetermined flow rate to the rotating platen of the chemical mechanical polishing apparatus. A standard curve made by polish rate vs. each of the openings 60 is prepared. Next, a desirable polish profile is obtained by selecting suitable opening to supply the CMP fluids according to the information related to the standard curve.

That is to say, the slurry having a predetermined flow rate is supplied according to calculation and combined by a measured polishing rate curve and a predetermined polishing profile.

According to the invention of the slurry supply system wafer polish throughput and polish uniformity can be improved. Also, a desirable polish profile of the polished layer can be obtained.

While the invention has been described with reference to various illustrative embodiments, the description is not intended to be construed in a limiting sense. Various modifications of the illustrative embodiments, as well as other embodiments of the invention, will be apparent to those skilled in the art upon reference to this description. It is therefore contemplated that the appended claims will cover any such modifications or embodiments as may fall within the scope of the invention defined by the following claims and their equivalents.

What is claimed is:

1. A slurry supply system disposed above the rotating platen of a chemical mechanical polishing apparatus, comprising:

a wafer carrier configured to hold a semiconductor wafer to be polished;

a supporting arm to support the wafer carrier;

a slurry supplier connected to the supporting arm and located on the front edge of the rotating direction of the rotating platen so that the slurry supplier is positioned opposite the wafer carrier; and a plurality of openings formed on the slurry supplier to feed chemical mechanical polishing fluids, each of the openings individually supplied with individual control of the chemical mechanical polishing fluids.

2. The slurry supply system disposed above the rotating platen of a chemical mechanical polishing apparatus as claimed in claim 1, wherein the slurry supplier is arc-shaped.

3. The slurry supply system disposed above the rotating platen of a chemical mechanical polishing apparatus as claimed in claim 1, further comprising a pair of bars located at the ends of the slurry supplier so that the slurry supplier is coupled to the supporting arm.

4. The slurry supply system disposed above the rotating platen of a chemical mechanical polishing apparatus as claimed in claim 3, wherein the bars are flexible so that the distance between the slurry supplier and the wafer carrier is controllable.

5. The slurry supply system disposed above the rotating platen of a chemical mechanical polishing apparatus as claimed in claim 1, wherein each of the openings connects to a flow rate controller via a conduit.

6. The slurry supply system disposed above the rotating platen of a chemical mechanical polishing apparatus as claimed in claim 5, wherein the flow rate controller is a valve.

7. The slurry supply system disposed above the rotating platen of a chemical mechanical polishing apparatus as claimed in claim 5, wherein the flow rate controller is a pump.

8. The slurry supply system disposed above the rotating platen of a chemical mechanical polishing apparatus as claimed in claim 1, wherein the chemical mechanical polishing fluids comprise slurry.

9. The slurry supply system disposed above the rotating platen of a chemical mechanical polishing apparatus as claimed in claim 1, wherein the chemical mechanical polishing fluids comprise deionized water.

10. The slurry supply system disposed above the rotating platen of a chemical mechanical polishing apparatus as claimed in claim 1, wherein the slurry supplier comprises a plurality of arc-shaped sections juxtaposed to each other to attached to the supporting arm.

11. A method for supplying slurry to the rotating platen of a chemical mechanical polishing apparatus, comprising the steps of:

providing a slurry supply system having a slurry supplier with a plurality of openings capable of individually adjusting the flow rate of the slurry; and selecting at least one of the openings to supply a slurry having a predetermined flow rate to the rotating platen of the chemical mechanical polishing apparatus.

12. The method for supplying slurry to the rotating platen of a chemical mechanical polishing apparatus as claimed in claim 11, wherein the slurry having a predetermined flow rate is supplied toward the front edge of the rotating direction of the rotating platen.

13. The method for supplying slurry to the rotating platen of a chemical mechanical polishing apparatus as claimed in claim 12, wherein the slurry having a predetermined flow rate is supplied according to a standard curve and a predetermined polishing profile, wherein the standard curve is made by polish rate versus each of the openings.

14. The method for supplying slurry to the rotating platen of a chemical mechanical polishing apparatus as claimed in claim 11, wherein the slurry supply system further comprises:

a wafer carrier configured to hold a semiconductor wafer to be polished;

a supporting arm to support the wafer carrier;

a slurry supplier connected to the supporting arm and located on the front edge of the rotating direction of the rotating platen so that the slurry supplier is positioned opposite the wafer carrier; and a plurality of openings formed on the slurry supplier to feed chemical mechanical polishing fluids, each of the openings individually supplied with individual control of the chemical mechanical polishing fluids.

15. The method for supplying slurry to the rotating platen of a chemical mechanical polishing apparatus as claimed in claim 11, wherein the slurry supplier is arc shaped.

16. A slurry supply system disposed above the rotating platen of a chemical mechanical polishing apparatus, comprising:

a wafer carrier configured to hold a semiconductor wafer to be polished;

a slurry supplier located on the front edge of the rotating direction of the rotating platen so that the slurry supplier is positioned opposite the wafer carrier; and a plurality of openings formed on the slurry supplier to feed chemical mechanical polishing fluids, each of the openings individually supplied with individual control of the chemical mechanical polishing fluids.

17. The slurry supply system disposed above the rotating platen of a chemical mechanical polishing apparatus as claimed in claim 16, wherein the slurry supplier is arc-shaped.

18. The slurry supply system disposed above the rotating platen of a chemical mechanical polishing apparatus as claimed in claim 16, wherein each of the openings connects to a flow rate controller via a conduit.

19. The slurry supply system disposed above the rotating platen of a chemical mechanical polishing apparatus as claimed in claim 18, wherein the flow rate controller is a valve or pump.

20. The slurry supply system disposed above the rotating platen of a chemical mechanical polishing apparatus as claimed in claim 16, wherein the slurry supplier comprises a plurality of arc-shaped sections juxtaposed to each other to attached to the supporting arm.

* * * * *